United States Patent [19]

Nagano

[11] Patent Number: 4,781,649

[45] Date of Patent: Nov. 1, 1988

[54] TOY CAR WITH A PARACHUTE

[75] Inventor: Toshiaki Nagano, Mibu, Japan

[73] Assignee: Shinsei Kogyo Co., Ltd., Tokyo, Japan

[21] Appl. No.: 916,202

[22] Filed: Oct. 7, 1986

[30] Foreign Application Priority Data

Apr. 14, 1986 [JP] Japan ..... 61-85641

[51] Int. Cl.[4] ..... A63H 17/00; A63H 33/20

[52] U.S. Cl. ..... 446/435; 446/51; 446/456; 244/147; 244/113

[58] Field of Search ..... 446/51, 50, 49, 52, 446/53, 435, 462, 457, 456, 54; 102/340, 387, 348, 354; 244/145, 147, 152, 113

[56] References Cited

U.S. PATENT DOCUMENTS

| | | | |
|---|---|---|---|
| 807,977 | 12/1905 | Van Vleet | 446/54 |
| 2,125,198 | 7/1938 | Pool | 446/49 X |
| 3,041,021 | 6/1962 | Jaffe | 244/147 |
| 3,589,055 | 6/1971 | Stormon | 446/53 |
| 4,008,541 | 2/1977 | Russer | 446/51 |
| 4,073,087 | 2/1978 | Ieda | 446/51 |

*Primary Examiner*—Mickey Yu

*Attorney, Agent, or Firm*—Kenyon & Kenyon

[57] ABSTRACT

A toy car with a parachute is disclosed in which the toy car, such as a formula type car with a rearwing, is formed with a running car body and a parachute-discharging device capable of accomodating and discharging the parachute which, in turn, may be hauled by the running car body with the parachute being open and in the air.

8 Claims, 6 Drawing Sheets

TOY CAR WITH A PARACHUTE

FIELD OF THE INVENTION

This invention relates to a toy car with a parachute, which is able to discharge an accommodated parachute while running and to haul the opened parachute in this flying position in the air.

BACKGROUND OF THE INVENTION

Most toy cars of a radio-controllable type have hitherto been constructed with steering and speed control. Some such cars have an ability to run with only their rear, power-driven, wheels on the ground (i.e., to do a "wheelie") in order to improve their attraction.

These conventional toy cars, however, cannot satisfy the desires of children only with steering operation, speed and wheelie running.

Accordingly, an object of the invention is to provide a toy car with a parachute of a new type which is attractive to children.

SUMMARY OF THE INVENTION

In order to achieve the above object, the invention provides a toy car with a parachute, comprising a running car body and a parachute-discharging device capable of accommodating and discharging the parachute, in which the parachute upon discharge from the device and opening in the air is hauled or pulled by the running car body through the air.

The toy car according to the invention may be in the form of a formula car which at its rearwing portion is formed as the parachute-discharging device.

In accordance with the invention, the parachute-discharging device may be slidably accommodated within a housing box having an openable door. A pushing body of the parachute-discharging device is directed towards the door while a resilient spring is compressedly received in the housing box. The housing box is provided an engaging mechanism for disengageably retaining the pushing body in the housing box with a resilient force being accumulated in the spring, thereby enabling the spring to push and move the pushing body against the door upon disengagement of the engaging mechanism. The folded and accommodated parachute is discharged from the housing box through the door upon opening thereof by the pushing body.

Further in accordance with the invention, the parachute is preferably in the form of a substantially half spherical surface made of a substantially circular and foldable fabric having a plurality of folded portions equally spaced apart circumferentially and symmetrically relative to respective lines passing through a center of the substantially circular fabric. Each folded portion is fixed to a front end of a respective string while base or rear ends of the strings fixed to the folded portions located on the right-half of the parachute are tied to one binding portion and the base ends of the strings on the left-half of the parachute are tied to another binding portion. Each of the binding portions is secured to a front end of a respective hauling string provided on its base or rear end with a fixture. The positions at which the strings are fixed to the folded portions on the lowest portions of the right and the left-halves of the parachute are located nearer to a center of the parachute than the fixing positions of the remaining strings, thereby providing a stable parachute preventing the parachute from contacting the ground while being hauled by the running car.

In accordance with the invention, the parachute may be accommodated in and discharged from the parachute-discharging device arranged within the car body. When the parachute is discharged from the device while the toy car is running, the parachute is opened by air resistance and hauled by the running car while maintaining its flying configuration.

In the parachute-discharging device, the pushing body may be kept within the housing box by the engaging mechanism. When the engaging mechanism is disengaged for releasing the accumulated force of the spring, the pushing body may be rapidly urged against the door for opening the door and discharging the folded and accommodated parachute through the opened door into the air.

The discharged parachute of the specified configuration may be stably maintained in its flying position while being hauled by the running toy car.

The invention will now be described in more detail hereinbelow with reference to the accompanying drawings.

PREFERRED EMBODIMENTS OF THE INVENTION

Figure 1:
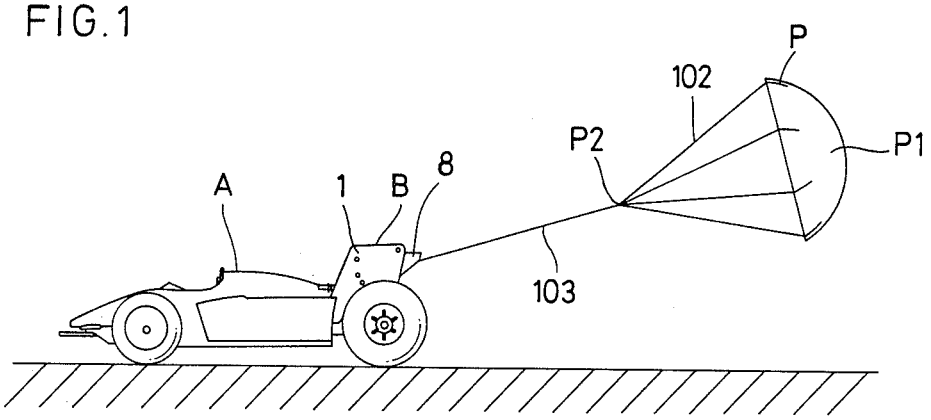
FIG. 1 is a side view of the toy car according to the invention in the running state with its parachute being opened.
Figure 2:
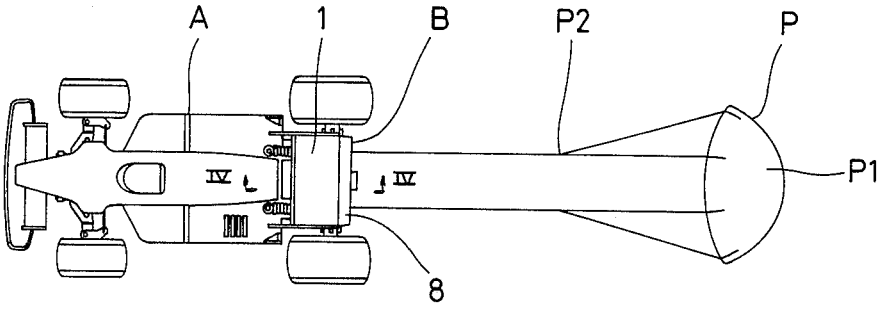
FIG. 2 is a top plan view of the toy car as shown in FIG. 1.
Figure 3:
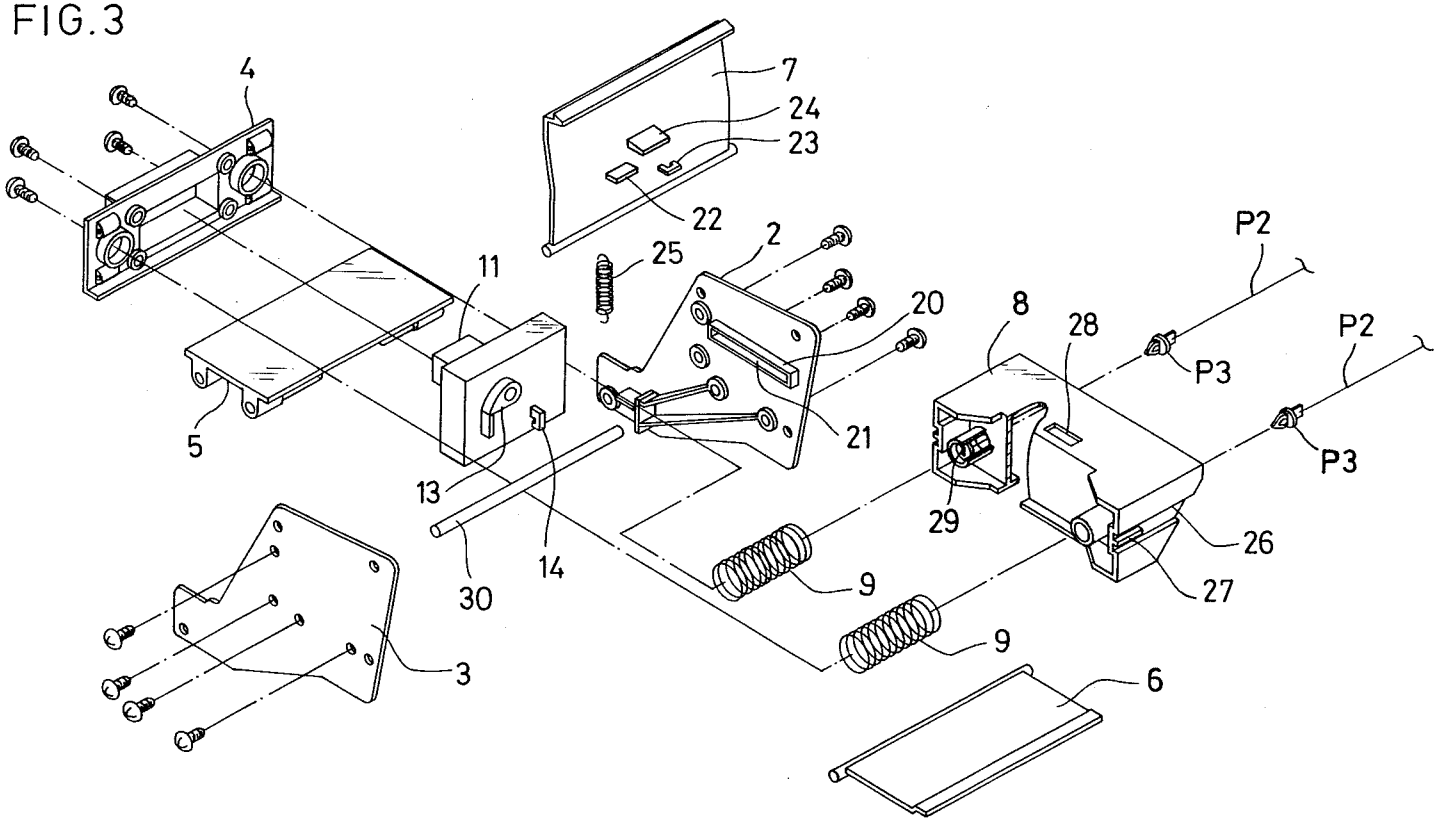
FIG. 3 is a disassembled perspective view of the parachute-discharging device to be accommodated in the toy car according to the invention.
Figure 4:
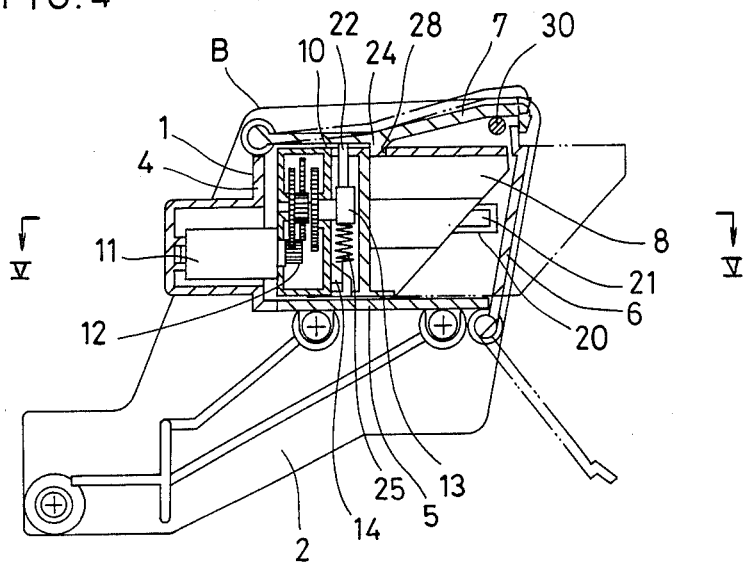
FIG. 4 is a vertical section of the parachute-discharging device taken along line IV—IV in FIG. 2.
Figure 5:
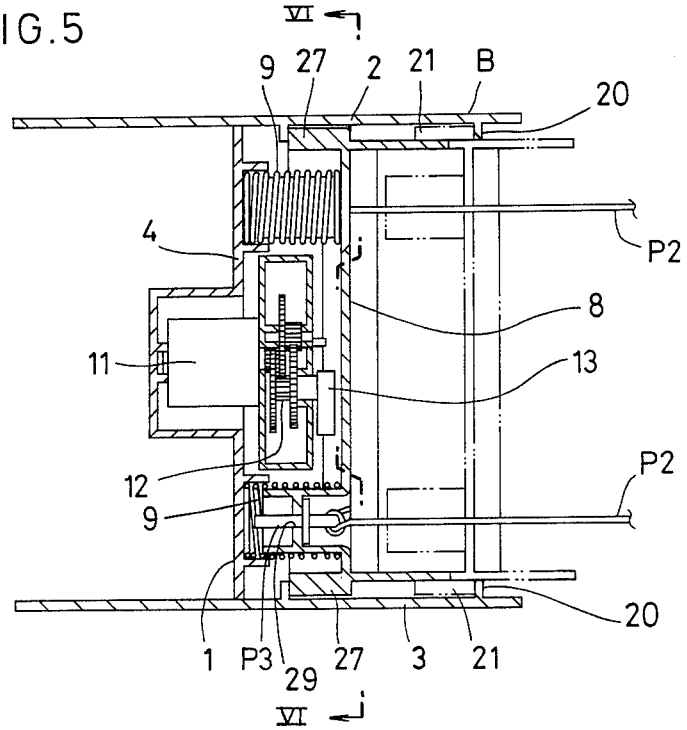
FIG. 5 is a cross-section taken along line V—V in FIG. 4.
Figure 6:
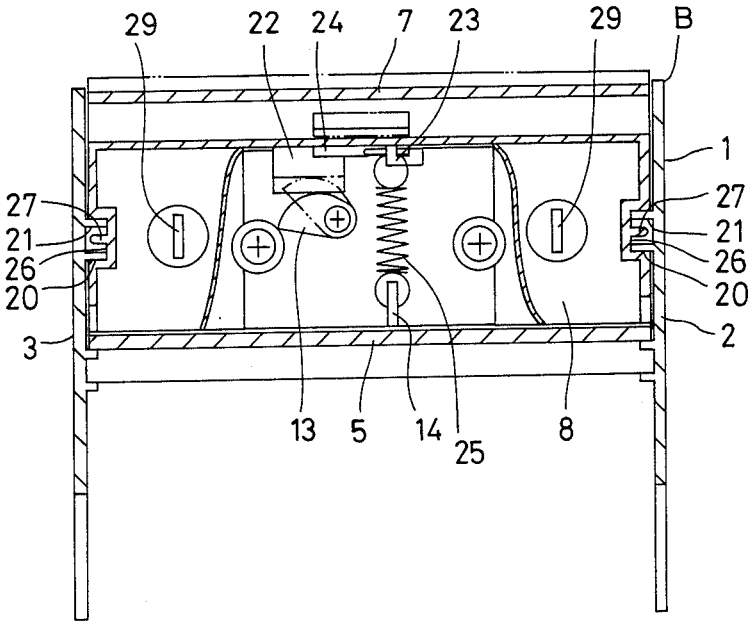
FIG. 6 is a vertical side sectional view taken along line VI—VI in FIG. 5.
Figure 7:
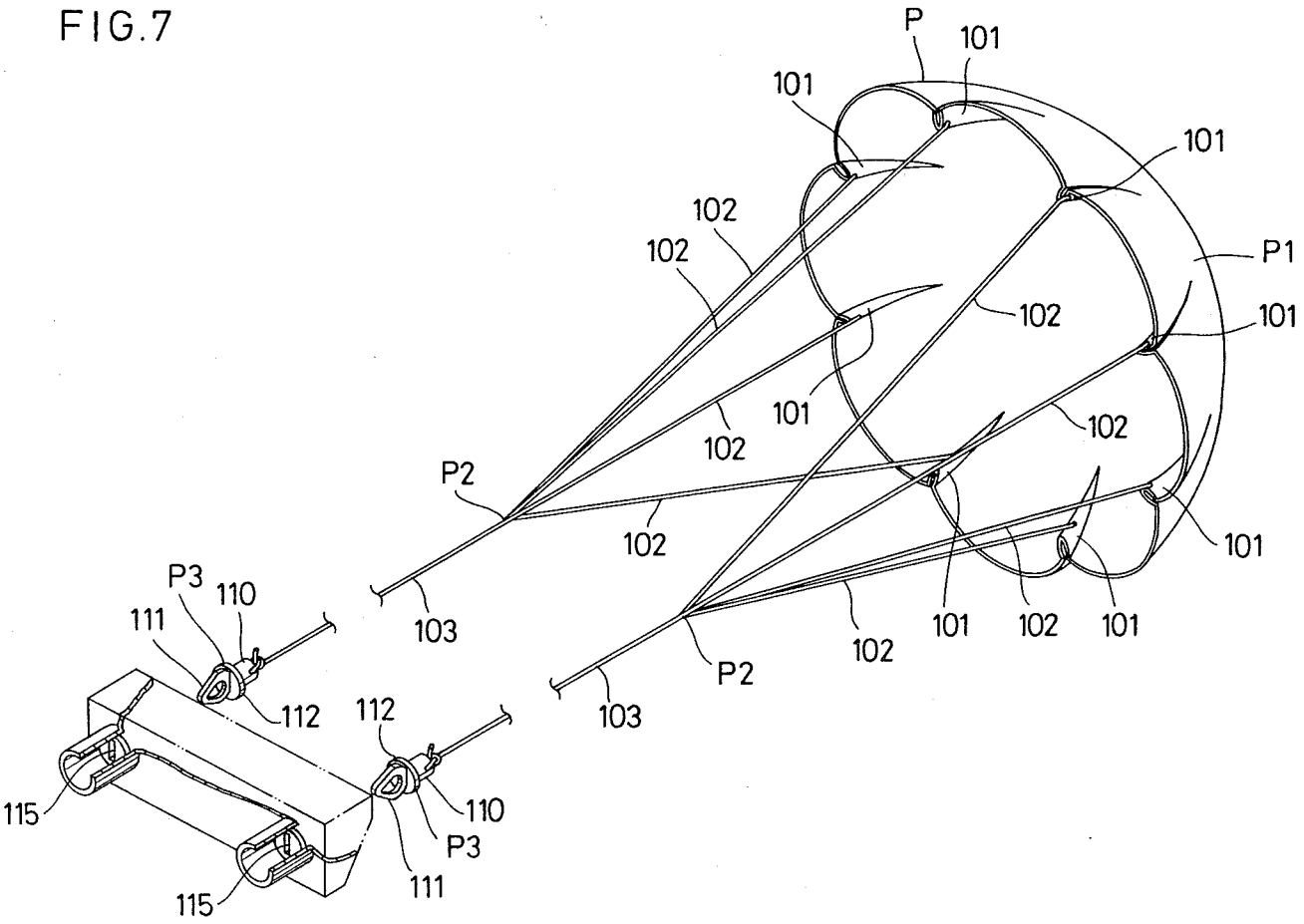
FIG. 7 is a perspective view of the parachute utilized in the toy car according to the invention.
Figure 8:
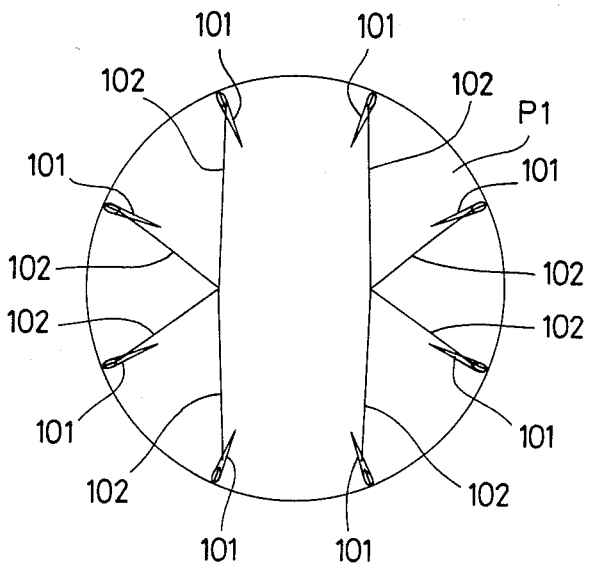
FIG. 8 is a front view of the parachute.

A toy car with a parachute as illustrated comprises a driving mechanism (not shown), a steering mechanism (not shown), a radio-controllable car body A in the form of a formula car and a parachute-discharging device B in the form of a rearwing of the formula car. The parachute-discharging device B may dischargeably accommodate a parachute P, as described hereinafter in detail, which may be opened by air resistance upon discharge and may be hauled through the air by the running car body A. Although the invention is described with reference to a toy car, it may be applied to toy vehicles of any type such as toy airplanes, spaceships, ships and others while these toy bodies are not restricted to a radio-controllable type.

The parachute-discharging device B comprises a housing box 1 provided at its rear with an openable door 6, a pushing body 8 received in the housing box 1 and slidably movable toward the door 6, a resilient spring 9 for urging the pushing body 8 against the door 6, and an engaging mechanism 10 for disengageably maintaining the pushing body 8 and spring 9 in a loaded state within the housing box 1.

The housing box 1 comprises a right side plate 2, a left side plate 3, a front plate 4, a bottom plate 5 and an openable door 6 swingably mounted to the right and left side plates 2, 3 through protrusions provided at a lower edge of the door. A swingable plate 7 is swingably mounted to the right and left side plates 2, 3 through protrusions provided at opposite ends of a front edge of plate 7. The door 6 at its upper edge is engaged releaseably with a rear edge portion of the swingable plate 7 for maintaining the door 6 in its closed state.

The pushing body 8 is substantially box shaped with a open rear, while at its front are arranged cylindrical protrusions spaced apart from each other for receiving resilient coil springs 9. Each of these cylindrical protrusions is provided therein with a fixture 29, while the pushing body 8 at its either side is provided with a guide groove 26 for receiving a guide 20 of a respective one of the right and left side plates 2, 3 as well as a stopper 27 received in a stopper-receiving groove 21 of the guide 20 and restricted for its moving range. Further, the pushing body 8 at its upper front side is provided with an engaging portion 28.

The engaging mechanism 10 is constructed in such a way that a rotational force of a motion 11 driven by a signal from a received (not shown) in the car body A is transmitted through a reduction gear mechanism 12 to a cam 13. Upon rotation, the cam contacts a cam-abutment 22 protruding from a lower face of the swingable plate 7 and enables the latter to swing upwardly against the resilient force (a restoring force) of a spring 25 secured at one end to an engaging portion 23 of the swingable plate 7 and at an opposite end to another engaging portion 14 of a case containing the reduction gear mechanism 12. The coaction of cam 13 and abutment 22 serves to disengage the rear edge of the swingable plate 7 from the upper edge of the door 6 and further to disengage an engaging portion 24 of the swingable plate 7 from an engaging portion 28 of the pushing body 8. The engaging mechanism, however, is not restricted to the illustrated embodiment but may be of any type provided that the engagement of the pushing body 8 with the housing box 21 may be readily ensured.

The parachute P comprises a parachute body P1, strings P2 attached at their front ends to the body P1, and fixtures P3 fixed to base or rear ends of the strings P2 and mounted to the parachute-discharging device B of the car body A. The parachute body P1 is in the form of a substantially half-spherical surface made of a substantially circular and foldable fabric having a plurality of folded portions 101 equally space apart circumferentially and symmetricaly relative to respective lines passing through a center of the fabric. Each folded portion is fixed to a front end of a respective string while base or rear ends of the strings fixed to the folded portions located on the right-half of the parachute are tied to one binding portion and the base or rear ends of the strings on the left-half of the parachute are tied to another binding portion. Each of the binding portions is secured to a front end of a respective hauling string provided on its base end with a fixture. The positions at which the strings are fixed to the folded portions at the lowest positions of the right and the left-halves of the parachute are located nearer to a center of the parachute than the fixing positions of the remaining strings. More particularly, the parachute is made of, for example, a substantially circular fabric having a diameter of about 330 mm, which is provided with a plurality of substantially triangular folded portions 101 each having at its peripheral edge a depth of about 5 mm. The depth of each folded portion is progressively reduced toward a center of the parachute and disappears at a distance of about 70 mm from the peripheral edge. Eight folded portions 101 are provided in total, four of which are arranged at an angular distance of about 45° from each other in the left-half of the parachute while the remaining four folded portions are arranged similarly in the right-half.

The string section P2 comprises a plurality (for example, eight pieces) of strings 102 and two hauling strings 103. Each string 102 at its front end is fixed to the corresponding folded portion 101. Base ends of the strings 102 fixed to the folded portions 101 located on the right-half of the parachute P1 are tied to one binding portion separately, the base ends of the strings 102 on the left-half of the parachute P1 are tied to another binding portion. Each hauling string 103 at its front end is secured to a respective binding portion of the strings 102 while at its base end is fixed to a string-attachment 110 of the fixture P3.

Further, the positions at which the strings 102 are fixed to the folded portions 101 to the lowest folded portions of the right and the left-halves of the parachute P1 are located nearer (for example, about 22 mm) to a center of the parachute than the fixing positions of the remaining strings.

The fixture P3 comprises a string-attachment 110 capable of securing the base end of the hauling string 103, an inserting portion 111 arranged adjacent to the string-attachment 110 and removably urged into a hole 115 of the parachute-discharging device B, and a flange 112 provided circumferentially between the string-attachment 110 and the inserting portion 111.

Figure 9:
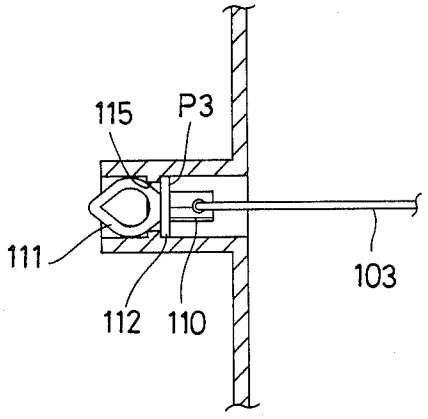
FIG. 9 is a sectional view of a fixture attached to the parachute.

The string-attachment 110 is provided with a small hole for binding the hauling string 103, while the inserting portion 111 is in the form of a substantially annular heart for facilitating insertion into the hole 115 and resilient deformation during the insertion. After the inserting portion 111 is urged into the hole 115, the maximum height of the inserting portion 111 becomes larger than the length of the hole 115, so that the inserting portion 111 cannot be readily removed from the hole 115 even when the opened parachute P1 is subject to air drag or resistance. Further, the flange 112 securely contacts a peripheral protrusion of the hole 115, so that the peripheral protrusion may be securely held between the inserting portion 111 and the flange 112 for securing the fixture P3, as shown in FIG. 9. The fixture, however, is not limited to such construction but may be of any type so far as the fixing may be readily and surely achieved.

The parachute P may be of any type, shape and size so far as it may surely maintain its flying position in the air against the air resistance. Further, the string P2 ay be attached directly to the pushing body 8 without the fixture P3.

In the drawings, reference 30 represents a cross-rod arranged behind the upper right and left side plates 2, 3 for reinforcing the entire housing box 1 and for preventing the swingable plate 7 from swinging downwardly.

The operation of the toy car according to the invention will now be described hereinbelow. At first, the pushing body 8 is urged against the resilient force of the spring 9 into the housing box 1 and the engaging portion 24 of the swingable plate 7 is engaged with the engaging portion 28. Then, the parachute P is optionally folded and received in the housing box 1 and the door 6 is swung so that its upper edge portion engages the rear edge portion of the swingable plate 7 in order to lock the door 6 in a closing position. Thereafter, the car body A is operated to run and the switch of the transmitter is energized for enabling the receiver to provide a current to the motor 11 for its rotation. Thus, the rotational force of the motor 11 is transmitted through the reduction gear mechanism 12 to the cam 13 for causing the latter to contact the cam-abutment 22 to cause the retraction thereof and to thereby urgedly raise the swingable plate 7 upwardly against the resilient force of the spring 25. As a result, the rear edge portion of the swingable plate 7 is disengaged from the upper side portion of the door 6 while the engaging portion 24 is also disengaged from the engaging portion 28, so that the pushing body 8 may slide rapidly and backwardly under the resilient force exerted by the spring 9, opening the door 6 and thereby discharging the folded and accommodated parachute P into the air through the opened door 6 of the housing box 1. The parachute P is opened by air resistance or drag and hauled in its flying state through the air by the running car body A.

In accordance with the invention, the toy car with the parachute comprises the movable car body A and the parachute-discharging device B capable of accommodating and discharging the parachute P. The parachute P is discharged from the device B and hauled by the running car body A through the air, thereby providing a novel and very amusing toy car for children.

With the radio-controllable car body A, the time point for discharging the parachute P may be remote-controlled while the toy car may be skillfully operated to maintain its speed so as not to drop the parachute P onto the ground.

Further, the car body A is in the form of a formula car which at its entire rearwing portion is formed as the parachute-discharging device B, thereby ensuring free and smooth discharge of the parachute P from the car body A, as well as the ready hauling of the parachute P. Such a construction is also suitable for accommodating the parachute P and provides an excellent appearance.

In accordance with the invention, the parachute-discharging device B is slidably accommodated within the housing box 1 having the openable door 6, the pushing body 8 of the device B being directed toward the door 6 while the resilient spring 9 is compressedly received. The housing box 1 is provided within the engaging mechanism 10 for disengageably keeping the pushing body 8 therein, resilient force being accumulated in the spring 9 to enable the spring 9 to push and move the pushing body 8 against the door 6 upon disengagement of the engaging mechanism 10 for opening the door and discharging the folded and accommodated parachute P from the housing box 1 through the opened door 6. The disengaging of the engaging mechanism 10 may release the accumulated resilient force of the spring 9 and unlock the door 6 of the housing box 1 for enabling the pushing body 8 to push and discharge the accommodated parachute P rapidly through the open door 6 into the air. Further, the parachute P accommodated within the housing box 1 may be covered by the door 6 and be invisible from the outside, resulting in a good appearance.

Further, the parachute P utilized in the toy car according to the invention may be hauled by the running car body A stably in its flying state in he air due to its specified configuration.

What is claimed is:

1. A toy vehicle comprising:

a vehicle body;

wheels rotatably mounted to said vehicle body;

a parachute;

housing means mounted to said vehicle body for accommodating said parachute in a storage state;

discharge means for ejecting said parachute from said housing means during motion of said vehicle body, said discharge means including a spring-loaded pusher element;

locking means operatively engageable with said discharge means for selectively preventing operation thereof; and releasing means including a camming mechanism operatively engageable with said locking means for releasing said locking means and thereby enabling said discharge means to eject said parachute from said housing means, said releasing means including a remote-controllable motor operatively connected at an output to said camming mechanism.

2. The toy vehicle set forth in claim 1 wherein said vehicle body takes the form of a formula car body and wherein said housing means is formed as an entire rearwing portion of said formula car body.

3. The toy vehicle set forth in claim 1 wherein said housing means is provided with a door, said pusher element being mounted for motion towards said door during an expulsion stroke of said pusher element.

4. The toy vehicle set forth in claim 3 wherein said locking means includes a plate pivotably mounted to said housing and having locking portions engageable with said pusher element and said door, said camming mechanism being engageable with said plate.

5. The toy vehicle set forth in claim 1 wherein said parachute takes the form of a substantially circular piece of fabric having a plurality of circumferentially equispaced folded portions each symmetrical with respect to a respective diametric line passing through a center of said parachute, each of said folded portions being fixed to one end of a respective string operatively tied at an opposite end to said pusher element.

6. The toy vehicle set forth in claim 5 wherein the strings are each fixed at said opposite end to a binding portion in turn fastened via a pullstring to said pusher element.

7. The toy vehicle set forth in claim 6 wherein said pullstring is provided at an end opposite said piece of fabric with fixture means for attaching said pullstring to said pusher element.

8. The toy vehicle set forth in claim 7 wherein a point of attachment of at least one of said strings to a respective one of said folded portions at a lowermost part of said parachute is located nearer to said center than points of attachment of others of said strings to respective ones of said folded portions.

* * * * *